US005161826A

United States Patent [19]

Van Giesen et al.

[11] Patent Number: 5,161,826

[45] Date of Patent: Nov. 10, 1992

[54] COMPOSITE MEDICAL INFORMATION AND IDENTITY CARD

[76] Inventors: Peter J. Van Giesen, 1888 Mt. Zion Rd., York, Pa. 17402; J. Joseph Danyo, 960 Upland Rd., York, Pa. 17403

[21] Appl. No.: 817,079

[22] Filed: Jan. 6, 1992

[51] Int. Cl.[5] ..... B42D 15/00

[52] U.S. Cl. ..... 283/77; 283/94; 283/900

[58] Field of Search ..... 283/77, 75, 94, 107, 283/112, 900, 904; 40/626

[56] References Cited

U.S. PATENT DOCUMENTS

| | | | |
|---|---|---|---|
| D. 284,581 | 7/1986 | Peterson | 283/900 |
| 3,414,998 | 12/1968 | Berger | 283/77 X |
| 3,616,121 | 10/1971 | Freundlich | 283/77 |
| 3,827,726 | 8/1974 | McVoy et al. | 283/77 X |
| 4,031,640 | 6/1977 | Hanna et al. . | |
| 4,236,332 | 12/1980 | Domo | 283/900 |
| 4,259,391 | 3/1981 | Brecht | 283/900 |
| 4,318,554 | 3/1982 | Anderson et al. . | |
| 4,648,189 | 3/1987 | Michel | 283/900 X |

*Primary Examiner*—Timothy V. Eley
*Assistant Examiner*—Willman Fridie, Jr.
*Attorney, Agent, or Firm*—C. Hercus Just

[57] ABSTRACT

A composite medical information and identity card adapted to be carried by a person who has had surgery resulting in installation of one or more metallic elements in his or her body of the type which, when passing through an X-ray inspection unit, results in the metal causing an alarm to be given. The card is composite and comprises a small basic card upon which is shown on one surface the name of the person, indication of the type of surgery, and the surgeon's name. The reverse side of the card is laminated with small photographs in side-by-side position respectively of the person's head and the X-ray of the surgery on the person, the card and photographs being sealed between two similar small sheets of transparent thermoplastic film which extend beyond the edges of the card sufficiently to be permanently heat-sealed and form a composite card.

5 Claims, 1 Drawing Sheet

COMPOSITE MEDICAL INFORMATION AND IDENTITY CARD

BACKGROUND OF THE INVENTION

When human bones of a person are broken, or need to be replaced with artificial portions or sections because of the pain caused by deteriorating bone or tissue, it is quite common surgical practice, at present, to replace deteriorating bone or re-connecting broken members of a bone by utilizing metallic members to reconnect broken portions of a bone member or replace a deteriorating portion of a bone member.

For example, a broken hip bone utilizes a metallic plate and screw of appropriate metal and shape to reconnect the broken members and restore the hip to normal use. In effect, modern surgical practice not only restores or replaces deteriorating bone sections but includes the possible replacement of substantially any bone member or bone portion of the human skeleton. Many of the foregoing examples utilize metal parts or sections which, when a restored anatomy is subjected to scanning by an X-ray machine, such as used in an airport, the presence of such metal in a human being will cause a signal to function in a manner to indicate the presence of metal in or on the person being scanned to detect such presence.

The principal purpose of the present invention is to provide a person who is being examined for the possible presence of metal upon his or her person with ready proof for an X-ray examiner that the cause of the alarm signal is a metallic part of the person's anatomy and particularly is not a weapon or other objectionable item.

SUMMARY OF THE INVENTION

In accordance with the principles of the present invention, a composite medical information and identity card comprising, for example, a basic identity card having thereon the name of the person having the metallic implant and the name of the physician who installed it, clearly shown on one surface of the card and the opposite surface of the basic card has flatly disposed thereon in side-by-side abutting relationship miniature photographs respectively of the person's head who has the implant for example, and an X-ray of said implant. A pair of similar small card-size transparent pieces of thermoplastic film are disposed respectively on opposite surfaces of said card and the edges of said film extend a suitable distance beyond the edges of said card for the purpose of being fused together and thus complete the formation of a durable, relatively stiff composite card to be carried by the person to whom it pertains. If desired, the aforementioned photography may be of the color-type or black and white-type.

A further object of the invention is to assemble and form said composite card in such a manner that the application of heat to the edges of said thermoplastic sheets also softens the entire thermoplastic sheet disposed over the photographs and conforms said film to the edges of said photographs in such a way as to offset the covering section of said film from the border portions of the film which are heat-sealed with the edges of the opposite sheet, whereby the offset portion of the film, immediately at the edges of said photographs, serves to frame the border edges of the photographs and thereby secures the same flatly against said basic card in a manner to prevent any lateral movement of said photographs relative to said card or each other.

If desired, a picture or photograph of the metal implant may be disposed on one side or the other of the basic card 12 for reference.

The foregoing object of the invention, as well as other objects thereof, are set forth in the following detailed description of the invention and are illustrated in the drawings thereof.

DETAILED DESCRIPTION OF THE PREFERRED EMBODIMENT OF THE INVENTION

Figure 1:
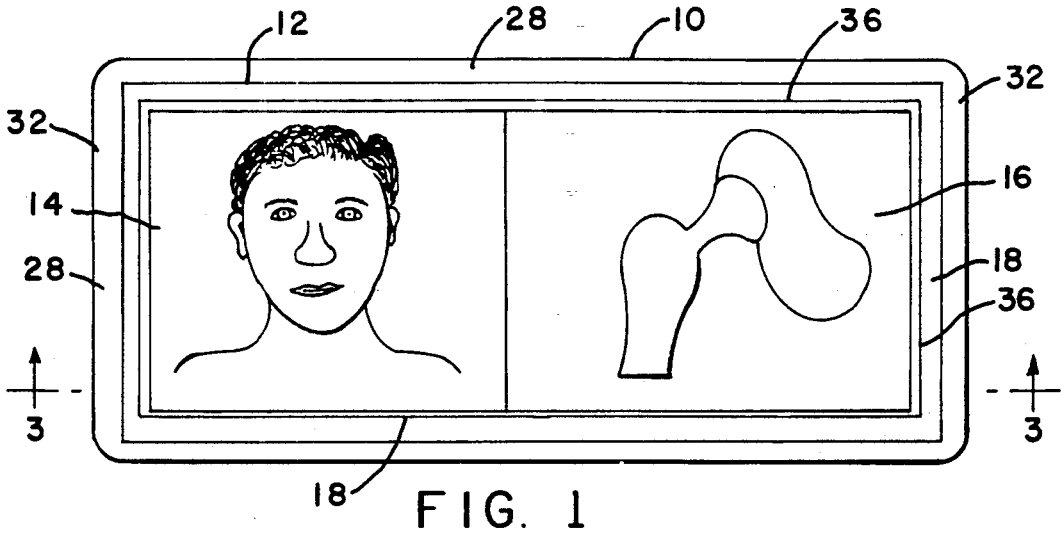
FIG. 1 is a plan view of one surface of the composite card comprising the invention.

Referring to FIG. 1, there is shown therein one surface of a composite card 10, preferably about the size of an automobile driver's permit and in which a basic card 12 of relatively thin cardboard or the like, similar to conventional calling cards, has superimposed on one surface thereof a photograph 14 in miniature size, such as a passport photo, of the head of the person who the composite card identifies, and a second photograph 16, of similar size and thickness as photograph 14, comprises a photograph of an X-ray showing a bone and metal complex which is a surgical replacement in the anatomy of the person shown in photograph 14. The photograph 16 is disposed upon said one surface of the basic card 12, in abutting edge-to-edge relationship with photograph 14. If desired, the basic card 12 may be of the same dimension as the side-by-side photographs 14 and 16. As illustrated in FIG. 1, the basic card 12 is of larger width and length than the side-by-side photographs, whereby border areas 18 of the basic card 12 are shown in FIG. 1.

Figure 2:
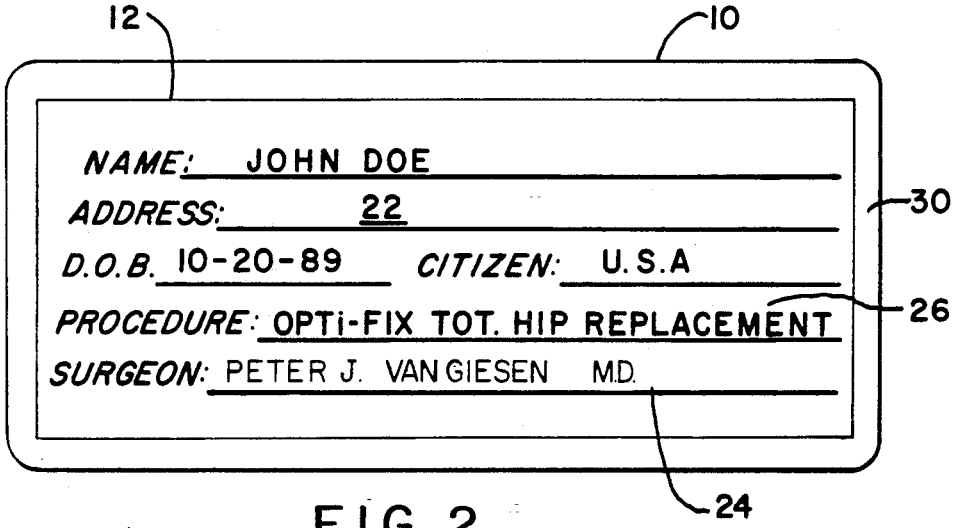
FIG. 2 is a plan view of the opposite surface of the card shown in FIG. 1.

Referring to FIG. 2, the reverse surface of basic card 12 is shown and upon which the name 20 of the person shown in photo 14 is printed or typed, as well as the person's address is completed in space 22 upon the basic card. Other identifying data of the person in photograph 14 also may be provided on basic card 12, such as the date on which the photograph was taken or the date on which the X-ray of photograph 16 was made, for example.

Another essential feature of basic card 12 is inclusion of the name 24 of the surgeon who performed the surgery and installed the replacement metal sections or elements in the anatomy of the person shown in photograph 14. Equally as important as the name of the surgeon is the medical identity 26 of the which occurred, such as shown on the exemplary basic card 12 of FIG. 2. Various additional data may also be included on the surface of the basic card 12 shown in FIG. 2, within the purview of the invention.

The composite card 10 also comprises a pair of similar sizes of transparent thermoplastic film members 28 and 30 of limited uniform thickness, and said film members are of a little greater width and length than basic card 12 in order to provide edge or border portions 32 and 34 which flatly abut each other and are fused together by suitably heated rollers or pressure members, not shown, which are of standard type used, for example, in the formation of automobile driver permit-issuing establishments and for various other similar purposes.

Figure 3:
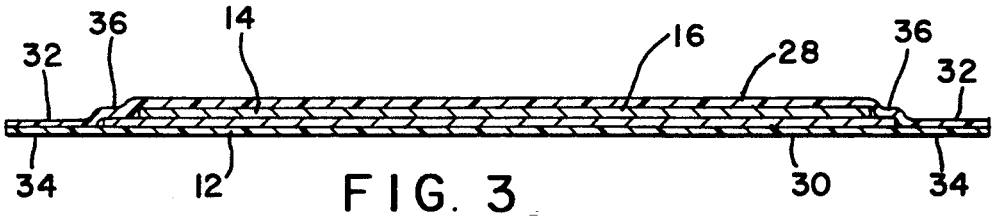
FIG. 3 is a vertical sectional view of the composite card shown in FIG. 1, as seen on the line 3—3 thereof.
Figure 4:
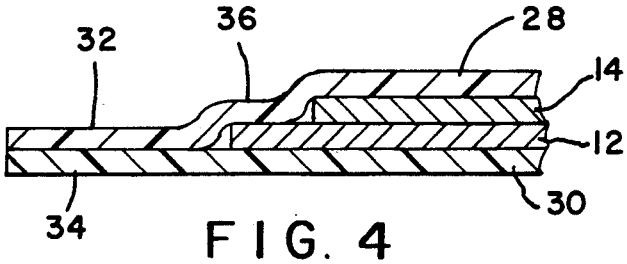
FIG. 4 is a fragmentary showing of the left-hand end portion of FIG. 3, on a larger scale than in FIG. 3, to more fully disclose details of the structure.

Incident to forming the assembly of the photographs 14 and 16 upon one surface of basic card 12, after the data describe above has been added to the outer surface of the card, such assembly is sandwiched between the similar film members 28 and 30. When the edge portions 32 and 34 of said film members have been fused by appropriate heat applied thereto, such heat application also softens the intermediate portions of the film members 28 and 30, whereby the application of pressure at least to film member 28, which overlies photographs 14 and 16, results in the formation of the frame-like portion 36 of film member 28, which surrounds the rims of photographs 14 and 16, and is depressed onto the rim of basic card 12, as can readily be seen from FIG. 3 and especially in the enlarged fragmentary FIG. 4.

The foregoing results in the photographs 14 and 16 being held securely in the desired positions thereof in the composite card 10, especially since the edge portions 32 of the piece of thermoplastic film 32 is securely fused to the edge portions 34 of thermoplastic film 30. The fabrication of the composite card 10 thus is completed and, upon cooling, said card is relatively stiff and readily adapted to be contained in a wallet, purse or otherwise.

With the foregoing in mind, it readily can be seen that when a person who has had a replacement metal object added to his or her skeleton and the wand of an X-ray examining machine is passed over the metal in the body of such person, an alarm will be triggered. However, if such person possesses a composite card of the present invention and shows it to the inspector, such showing should result in aiding the person to be cleared for passage to a plane or the like. Usually such person also will have surgical scars which will confirm the inclusion of metal in the person's anatomy.

The formation of such composite card also is very simple and requires no more than the use of well-known and readily available heating devices now in wide and common use.

The foregoing description illustrates the preferred embodiment of the invention. However, concepts employed may, based upon such description, be employed in other embodiments without departing from the scope of the invention. Accordingly, the following claims are intended to protect the invention broadly, as well as in the specific forms shown herein.

I claim:

1. A composite medical information and identity card comprising in combination, a relatively small basic card having on one surface thereof the name of the person to whom the information and identity pertains, and a relatively small photograph of said person and a correspondingly small photograph of an X-ray of a bone and metal complex which has surgically replaced with metal at least part of the original anatomy of said person, said photographs being arranged adjacent each other in flat side-by-side relationship and overlying the surface of said basic card opposite said one surface thereof and disposed at least within the borders of said basic card, and a pair of similar transparent thermoplastic film sheets disposed in sandwich-like disposition respectively on said one surface and the opposite surface of said basic card and photographs thereon, the edges of said sheets being spaced outwardly of the edges of said basic card and at least the edges of said sheets beyond the edges of said basic card being heat-sealed to form a composite card of a size suitable to be carried in a wallet, purse or otherwise.

2. The composite medical information and identity card according to claim 1 wherein the portion of the film sheet which overlies said photographs is offset from the plane of the edges of said sheet by the thickness of said photographs from the fused edges of said sheet and thereby effectively positions said photographs against displacement in the composite card.

3. The composite medical information and identity card according to claim 2 in which the portion of said film sheet which is offset from the edges thereof is formed incident to heat-sealing said edges of said sheets.

4. The composite medical information and identity card according to claim 3 in which said photographs are in side-by-side abutting relationship and the edge of the offset portion of said one film sheet effectively secures said abutting edges intact.

5. The composite medical information and identity card according to claim 1 further including the name of the person's physician on said one surface of said card upon which the name of said person is included.

* * * * *